US005272837A

United States Patent [19]

Nolte et al.

[11] Patent Number: 5,272,837

[45] Date of Patent: Dec. 28, 1993

[54] OPERATOR FOR AN AWNING TYPE WINDOW

[75] Inventors: Douglas A. Nolte; Gregory J. Vetter, both of Owatonna, Minn.

[73] Assignee: Truth Div. of SPX Corporation, Owatonna, Minn.

[21] Appl. No.: 999,221

[22] Filed: Dec. 31, 1992

[51] Int. Cl.[5] ..... E05F 11/00

[52] U.S. Cl. ..... 49/324

[58] Field of Search ..... 49/324, 345, 346, 341, 49/342, 343, 344

[56] References Cited

U.S. PATENT DOCUMENTS

| | | | |
|---|---|---|---|
| 2,185,321 | 1/1940 | Thoma . | |
| 2,674,452 | 4/1954 | Hummert . | |
| 2,824,735 | 2/1958 | Stavenau et al. . | |
| 3,032,330 | 5/1962 | Stavenau . | |
| 3,044,311 | 7/1962 | Gagnon . | |
| 3,098,647 | 7/1963 | Teggelaar et al. | 49/342 X |
| 3,422,575 | 1/1969 | Armstrong | 49/324 X |
| 3,523,389 | 8/1970 | Gray | 49/324 |
| 4,068,408 | 1/1978 | Hauber . | |
| 4,143,556 | 3/1979 | Hauber . | |
| 4,241,541 | 12/1980 | Van Klompenburg et al. | 49/342 X |
| 4,253,276 | 3/1981 | Peterson et al. | 49/345 X |
| 4,266,371 | 5/1981 | Erdman et al. . | |
| 4,305,228 | 12/1981 | Nelson | 49/324 X |
| 4,617,758 | 10/1986 | Vetter | 49/324 |
| 4,823,508 | 4/1989 | Allen | 49/341 X |
| 4,840,075 | 6/1989 | Tucker | 49/341 X |
| 4,843,703 | 7/1989 | Nolte et al. . | |
| 4,845,830 | 7/1989 | Nolte et al. . | |

FOREIGN PATENT DOCUMENTS

| | | |
|---|---|---|
| 595250 | 3/1960 | Canada . |
| 889194 | 12/1971 | Canada . |

*Primary Examiner*—Philip C. Kannan

*Attorney, Agent, or Firm*—Wood, Phillips, Van Santen, Hoffman & Ertel

[57] ABSTRACT

An operator for an awning type window having a sash pivotable about its top side relative to a window frame, with the operator controlling opening and closing movement of the sash relative to the frame. The operator includes a drive gear secured to a base on the frame, a sun gear pivotable about the axis on the base and drivably engaging the drive gear, a primary arm with a planetary gear rotationally attached thereon and drivably engaging the sun gear, a secondary arm pivotally mounted about a second axis on the base, and a pair of drive links pivotally interconnected between the planetary gear and the secondary arm. A bracket is fixed to the sash side opposite the one sash side, a first connecting arm is pivotally connected at one end to the primary arm and at the other end to the bracket, and a second connecting arm is pivotally connected at one end to the secondary arm and at the other end to the bracket, where all of the arms cooperate to move the sash bottom side toward and away from the frame to control opening and closing of the sash in response to rotation of the drive gear. The base includes a fixed primary arm stop which engages the primary arm to prevent lateral shifting of the window when the sash is closed against the frame. The base also includes a fixed secondary arm stop which engages the secondary arm to prevent lateral shifting of the sash during initial opening of the sash from a position closed against the frame.

17 Claims, 2 Drawing Sheets

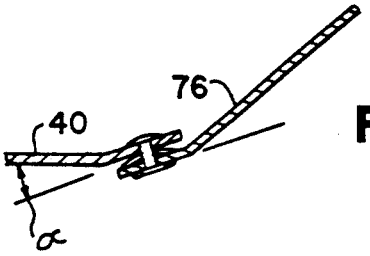
Fig. 4
Fig. 5
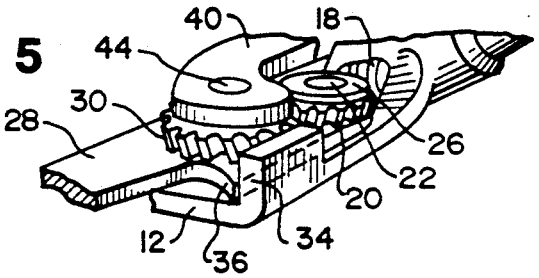
Fig. 6
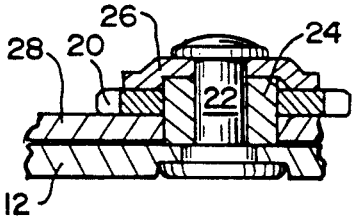
Fig. 7
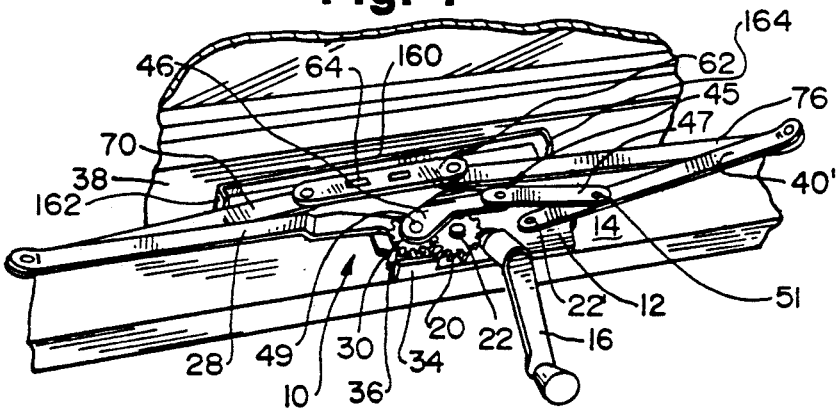
Fig. 8
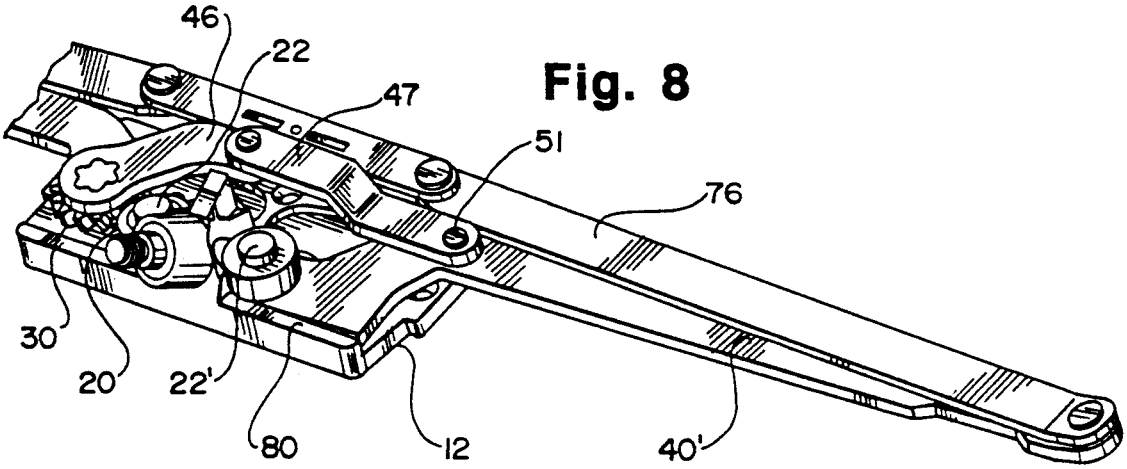

OPERATOR FOR AN AWNING TYPE WINDOW

BACKGROUND OF THE INVENTION

1. Technical Field

The present invention is directed toward a window operator, and more particularly toward an operator for opening and closing an awning type window.

2. Background Art

Manually operable window operators for casement and awning type windows are well known in the art.

In casement type windows, a window and sash are mounted for pivoting about one of the vertical sides, and the operator connects to an adjacent side for pivoting the sash for opening and closing. A variety of operators usable with casement type windows are shown, for example, in commonly owned Van Klompenburg et al. U.S. Pat. No. 4,241,541, Peterson et al. U.S. Pat. No. 4,253,276, Erdman et al. U.S. Pat. No. 4,266,371, Nelson U.S. Pat. No. 4,305,228, Allen U.S. Pat. No. 4,823,508, Tucker U.S. Pat. No. 4,840,075, and Nolte et al. U.S. Pat. Nos. 4,843,703 and 4,845,830.

With awning type windows, the window and sash are mounted for pivoting about one of the horizontal sides (generally the top side), and the operator connects to the opposite side to control opening and closing of the sash. An operator usable with awning type windows is shown, for example, in my commonly owned U.S. Pat. No. 4,617,758.

Naturally, operators for the different types of windows have some common features. For example, with either type window, it is typically for the operator to have a mounting base which rotatably mounts a gear and pull arm. The gear meshes with a worm gear on a worm shaft having a handle affixed thereto and a pull arm is operatively connected to a window whereby rotation of the worm shaft results in rotation of the gear and the pull arm for window movement.

Nevertheless, it is well understood by those having skill in the art that operators for awning type windows not only operate differently than operators for casement type windows (due to the different movement of the sash relative to the operator base), but they encounter and must be able to withstand distinctly different forces and stresses during operation. For example, motion of the bottom portion of the pivoting sash of an awning type window is both out and up relative to the frame; there is no lateral (sideways) motion. Accordingly, it is desirable to minimize any lateral forces introduced to the sash by the operator, since such forces are counterproductive, can unnecessarily stress and therefore damage the hinges at the top of the sash, can cause the sash to not provide a proper weather seal, and can even prevent the operator from properly working.

Of course, it is also more generally desirable for any such operator to be easily and inexpensively manufactured and installed. It is still further desirable for such operators to provide reliable and smooth operation over the long life of whatever awning type window structure it controls for opening and closing.

SUMMARY OF THE INVENTION

In one aspect of the present invention, an operator is provided for an awning type window having a sash pivotable about its top side relative to a window frame, with the operator controlling opening and closing movement of the sash relative to the frame. The operator includes a drive gear secured to a base on the frame, a sun gear pivotable about an axis on the base and drivably engaging the drive gear, a primary arm with a planetary gear fixed thereon and drivably engaging the sun gear, a secondary arm pivotally mounted about a second axis on the base, and a drive linkage pivotally interconnected between the primary arm and the secondary arm. The primary and secondary arms are connectable to the sash bottom side to control movement of the bottom side toward and away from the frame in response to rotation of the drive gear.

In another aspect of the present invention, the arm and sash connection includes a bracket fixed to the sash side opposite the one sash side, a first connecting arm pivotally connected at one end to the primary arm and at the other end to the bracket, and a second connecting arm pivotally connected at one end to the secondary arm and at the other end to the bracket. The primary, secondary, and connecting arms cooperate to move the sash bottom side toward and away from the frame for opening and closing of the sash.

In still another aspect of the present invention, the base includes a fixed primary arm stop which engages the primary arm to prevent lateral shifting of the sash when closing the sash against the frame.

In yet another aspect of the present invention, the base includes a fixed secondary arm stop which engages the secondary arm to prevent lateral shifting of the sash during initial opening of the sash from a position closed against the frame.

It is an object of the present invention to provide an awning type window operator which may be easily and inexpensively manufactured as well as easily and inexpensively installed.

It is another object of the present invention to provide an awning type window operator which provides reliable and smooth operation, without binding and without damaging the sash hinge, over the long life of the window structure which it controls.

It is still another object of the present invention to provide an awning type window operator which ensured that the sash will be properly sealed against the frame.

BRIEF DESCRIPTION OF THE DRAWINGS

FIG. 4 is a broken partial view taken along line 4 of FIG. 2;

FIG. 5 is a perspective view a portion of the operator of the present invention;

FIG. 6 is a cross-sectional view taken along line 6—6 of FIG. 3;

FIG. 7 is a broken partial view of a closed awning type window having an alternative hook member; and FIG. 8 is a broken partial view of a closed awning type window having a rib on the operator base.

DESCRIPTION OF THE PREFERRED EMBODIMENT

Figure 1:
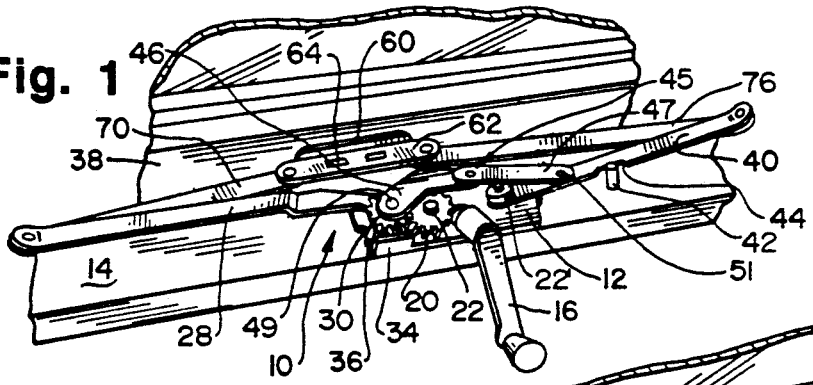
FIG. 1 is a broken partial view of a closed awning type window including the novel operator of the present invention.

FIGS. 1–4 show the window operator 10 of the present invention in various configurations moving an awning type window from a window sash closed to a window sash fully open position. (Note that, for purposes of illustration, FIGS. 1-4 show the operator 10 as installed but with the working components visible, i.e., without the protective and decorative operator cover and frame trim which are typically used in such installations.)

Specifically, the operator 10 includes a base 12 suitably secured to the window frame 14. A handle 16 is pivotally mounted to the base 12 to allow manual rotation of a worm 18 (see FIG. 5) to control the operator 10 as is hereafter described.

A primary or sun gear 20 is pivotally secured to the base 12 for rotation about an axis defined by a suitable pin such as a rivet 22 (see FIG. 6). As shown in FIG. 6, a bushing 24 and washer 26 may be advantageously used to help to ensure reliable, wobble-free rotation of the primary gear 20.

A primary arm 28 is pivotally secured to the base 12 about the same axis as the primary gear 20, and is pivotally connected to a secondary or planetary gear 30 which drivably engages the primary gear 20.

The base 12 includes a fixed primary stop 34 which engages the primary arm base portion 36 during closing of the sash 38 (see FIG. 1) as is described in greater detail hereafter.

A secondary arm 40 is pivotally secured to the base 12 for rotation about an axis defined by a suitable pin such as a second rivet 22'.

A fixed secondary stop 42 engages a notch 44 on secondary arm 40 during initial opening of the sash 38 (see FIG. 1) as is described in greater detail hereafter.

A linkage 45 pivotally interconnects the primary arm 28 and the secondary arm 40. More particularly, the linkage 45 has a drive link 46 rotatably coupled to a follow link 47 with a pivot pin 48. One end of the drive link 46 and the secondary gear 30 are mounted about a suitable pin or rivet 49, and one end of the follow link 47 and the secondary arm 40 are mounted about a suitable pin or rivet 51.

A suitable bracket structure connects the operator 10 to the window sash 38. Specifically, this structure includes a hook member 60 suitably fixed to the sash 38 and an eye member 62 having openings 64 receiving hooks 66 of the hook member 60 (see FIGS. 1-3). Such connections are generally known in the art for awning type window operators, and commonly include a suitable locking member (not shown) to allow the hook member 60 and eye member 62 to be connected and disconnected when desired for easy installation, maintenance, window washing, and/or egress through the window.

A first connecting arm 70 is pivotally secured on one end to the primary arm 28 and on the other end to the eye member 62. A second connecting arm 76 is pivotally secured on one end to the secondary arm 40 and on the other end to the eye member 62.

In order to accommodate the non-linear motion of the sash 38 relative to the operator base 12 (as a result of the pivotal motion of the sash 38 relative to the frame 14), the pivotally connected ends of the primary arm 28 and the first connecting arm 70, and the secondary arm 40 and the second connecting arm 76, are disposed at angles relative to their longitudinal direction as illustrated in FIG. 4 with the angle of the secondary arm 40 designated "$\alpha$". This configuration allows the connected arms 28, 70, and 40, 76 to be disposed generally parallel to each other when the window sash 38 is closed (with essentially no vertical offset up from the frame 14) while also accommodating the increasing amounts of upward movement of the sash 38 as it is opened.

Operation of the above described operator 10 is as follows.

As best illustrated in FIGS. 1-4, when the window sash 38 is closed against the frame 14, a person may turn the handle 16 which in turn pivots the worm 18. Pivoting of the worm 18 in turn applies a force (through the driving engagement of the primary and secondary gears 20, 30) which tends to move both the primary arm 28, the drive linkage 45, and the secondary arm 40 in a direction to open the sash 38.

However, because of the sun-planet relationship of the primary and secondary gears 20, 30, the force applied to the eye member 62 by the primary arm 28 and first connecting arm 70 can be twice as much as the force applied by the secondary arm 40 and the second connecting arm 76. Such a force differential (resulting in an undesirable net lateral force component being applied to the sash 38) is during most operation small enough so as to not damage the hinges used in today's awning type windows. However, this force differential is much greater when the window sash 38 is first opened due to the high force required to break the sash 38 free of the weatherstrip mounted to the frame 14 of virtually all windows today.

Specifically, during initial opening it is common for the relatively high forces generated by the operator 10 to cause a small amount of lateral movement of the sash 38 until the seal with the weatherstrip is broken. Due to the configuration of the operator 10, that lateral motion could be great enough to result in the connected ends of the primary arm 28 and the first connecting arm 70 touching the sash 38. If that were to occur, the first connecting arm 70 would essentially pass beyond its connection to the eye member 62, with the result then being that the forces of the primary and first connecting arms 28, 70 tend to close the sash 38 rather than open it. Therefore, rather than opening the sash 38 when desired, the operator 10 would lock up and, if forced by the person trying to open the sash 38, could result in damage to the operator, sash, and/or sash hinge.

The secondary arm stop 42 prevents the above undesirable operation, however, since it ensures that the secondary arm 40 does not rotate beyond a preferred configuration. Since lateral movement of the sash 38 is avoided (because the secondary stop 42 is located so as to engage the notch 44 on the secondary arm 40 in the closed position that results in no lateral shift), the first connecting arm 76 is prevented from passing beyond its connection to the eye member 62 even during initial opening when the sash 38 is freed from the weatherstrip. Consequently, the operator 10 will never lock up.

Figure 2:
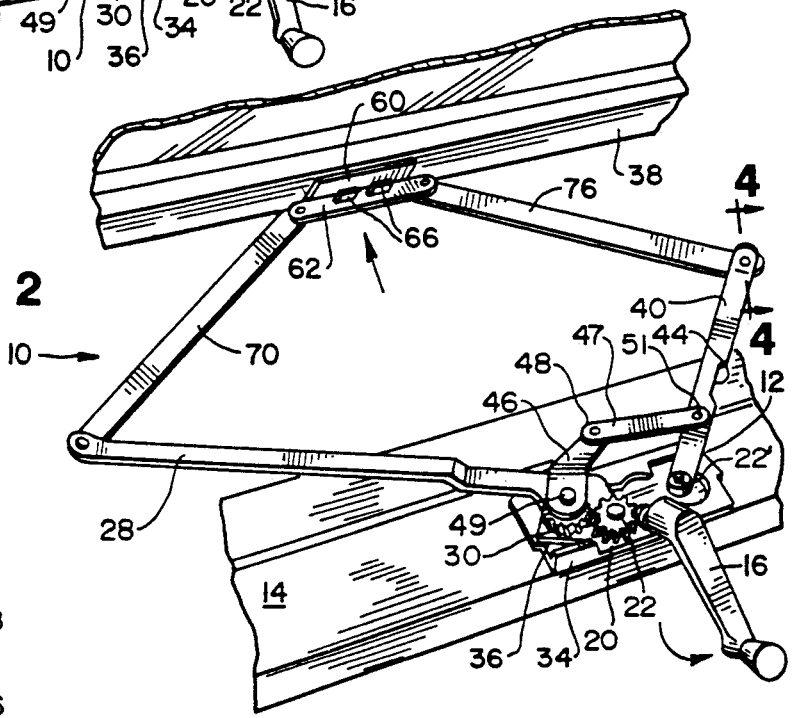
FIG. 2 is a view similar to FIG. 1, but showing the window in an intermediate open position.
Figure 3:
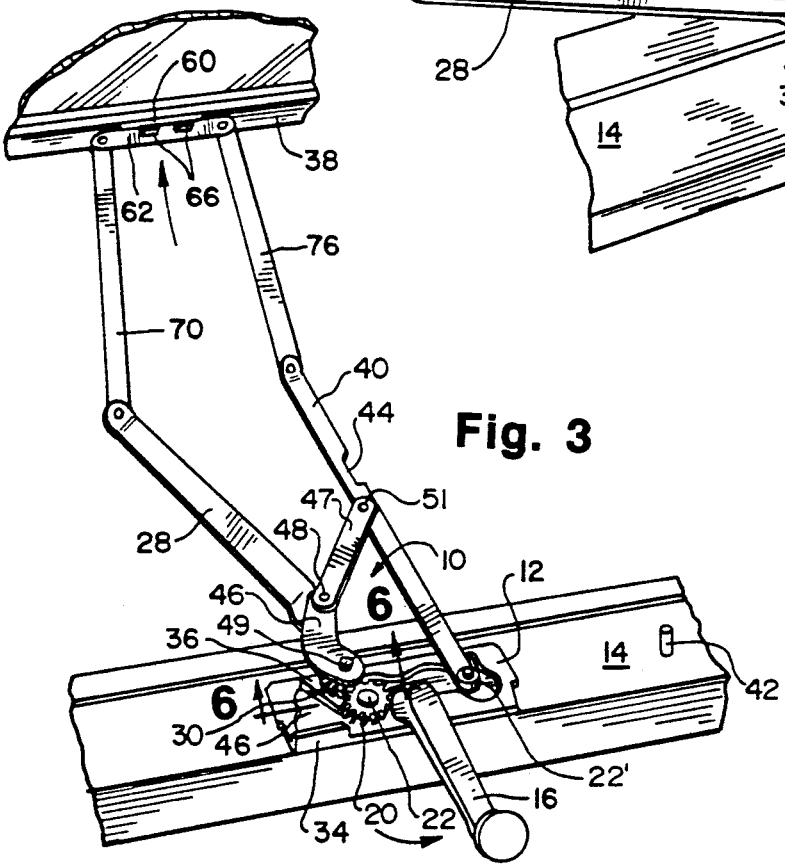
FIG. 3 is a view similar to FIG. 2, but showing the window in its fully open position.

Continued turning of the handle 16 after breaking the seal will continue to extend the arms 28, 40, 70, 76 to open the sash 38 to the fully open position (see FIG. 3) or to any desired partially open position (only one of which is shown in FIG. 2).

For closing the sash 38, the handle 16 is turned in the opposite direction to cause the primary gear 20 to be pivoted counterclockwise and thereby pivot the primary arm 28, the drive linkage 45, and the secondary arm 40 (and therefore the sash 38) back toward the frame 14.

When the sash 38 is nearly fully closed, a greater force is again desirable in order to pull the sash 38 into a tight seal against the weatherstrip. However, this greater force can again result in a differential lateral force such as previously described which could layerally shift the sash 38 slightly. Such lateral shifting, if allowed, could result in the sash 38 being mispositioned relative to the frame 14 so that the weatherstrip may seal tightly on one side of the sash 38 and not at all on the other. This is obviously an undesirable situation.

The primary stop 34 prevents the above undesirable operation, however. Specifically, while the configuration of the operator 10 is such that a greater force is naturally applied to the primary arm 28 than the secondary arm 40, the primary stop 34 is located so as to engage the primary arm base member 36 in the closed position that results in no lateral shift. Continued turning of the handle 16 therefore cannot cause any undesirable lateral shift of the sash 38 but instead increases the force to the sash 38 through the secondary and second connecting arms 40, 76 to thereby ensure that the sash 38 is properly sealed against the weatherstrip.

During closing, it is also desirable that a maximum closing force be applied during the last stages of closing as such forces will act to provide a tight seal against the weather sealing typically provided around such window frames. In order to accomplish this, it is preferred that the drive link 46 and follow link 47 be so sized and configured that at the last stage of closing they approach a toggle position (with the pivot pin 48 between them approaching a line between the pivot pins 49, 51 at their opposite ends). With such a configuration, the axial force applied on the follow link 47 (which force applies the turning torque to the secondary arm 40) is maximized (theoretically approaching infinity at the toggle position) to thereby maximize the closing force as mentioned.

It is also desirable to provide an additional force during initial opening of the window in order to break the window free from the seal along the weather strip typically provided with windows. The above described configuration provides such operation, as the follow link 47 will pull on the secondary arm 40 with maximum force relative to the torque applied on the operator handle 16 based on the "near toggle" position of the drive and follow links 46, 47 during initial opening.

FIGS. 7–8 show alternative structure for preventing lock up of the operator 10 during initial opening when the sash 38 is freed from a weatherstrip.

Referring to FIG. 7, an alternative bracket structure for connecting the operator 10 to the window sash 38 includes an elongated hook member 160 suitably fixed to the sash 38 and an eye member 62 having openings 64 for receiving hooks (not shown in FIG. 7) of the hook member 160. The hook member 160 has a pair of integral spaced apart tabs or sash stops 162, 164 which project perpendicularly to the sash 38 and contact a corresponding one of the connecting arms 70, 76, respectively, when the sash 38 is in a closed position. The sash stops 162 and 164 maintain a minimum spacing between the sash 38 and the connecting arms 70, 76 to prevent the connecting arms 70, 76 from passing beyond their connections to the eye member 62, even during initial opening of the sash 38. Consequently, lock up of the operator 10 is prevented.

FIG. 8 shows a rib 80 suitably fixed to the operator base 12, as by staking. The rib 80 is located so as to engage the base portion 82 of a secondary arm 40' in the closed position of the operator 10 that results in no lateral shift of the sash 38. The rib 80 therefore prevents lock up of the operator 10 when the sash 38 initially is opened in a manner similar to the secondary arm stop 42 discussed above with respect to FIGS. 1–4.

Still further, it should be understood that the operator of the present invention could be attached to the window sash in a manner different than that shown. Specifically, for example, the connecting arms 70, 76 could in some applications be omitted with the primary and secondary arms instead connected to a guide bar structure in a manner similar to that shown in Vetter U.S. Pat. No. 4,617,758, the complete disclosure of which is hereby incorporated by reference.

As will be understood by those who have gained an understanding of the present invention through the disclosure herein, the above described operator 10 will provide reliable and smooth operation, without binding and without damaging the sash hinge, over the long life of the window structure which it controls. Further, this operator 10 will ensure that the sash 38 will provide the desired seal against weather when closed. Still further, this operator 10 is simple and therefore may be easily and inexpensively manufactured as well as easily and inexpensively installed and maintained.

Still other aspects, objects, and advantages of the present invention can be obtained from a study of the specification, the drawings, and the appended claims.

We claim:

1. An operator for controlling movement of an awning type window pivotable about one side relative to a frame, comprising:

a drive gear pivotally mounted to a base on the frame;

a sun gear pivotable about an axis on said base and drivably engaging said drive gear;

a primary arm pivotable about the sun gear axis and including a planetary gear rotationally attached thereto and drivably engaging said sun gear;

a secondary arm pivotable about a second axis on said base;

a drive linkage pivotally interconnected between the primary arm and the secondary arm; and means connecting said primary and secondary arms to the window side opposite the one window side about which the window pivots for moving said opposite side toward and away from said frame in response to rotation of said drive gear.

2. The operator of claim 1, wherein the drive linkage comprises a pair of pivoted links secured at an end of one of the links to the planetary gear and pivoted at an end of the other of the links to the secondary arm.

3. The operator of claim 1, further comprising a primary arm stop fixed relative to the base and engaging said primary arm to prevent lateral shifting of the window when said window is closed against said frame.

4. The operator of claim 1, further comprising means for preventing lateral shifting of the window when window is initially opened from a position closed against said frame.

5. The operator of claim 4, wherein said means comprises a secondary arm stop fixed relative to the base and adapted to engage said secondary arm during initial opening of said window.

6. The operator of claim 1, wherein said moving means comprises:

a bracket fixed to said opposite window side;

a first connecting arm pivotally connected at one end to the primary arm and at the other end to the bracket;

a second connecting arm pivotally connected at one end to the secondary arm and at the other end to the bracket.

7. The operator of claim 6, wherein:

said arms each have a longitudinal direction;

the first connecting arm is connected to the primary arm for pivotal motion about a first axis which is oblique relative to both longitudinal directions of the primary arm and the first connecting arm; and the second connecting arm is connected to the secondary arm for pivotal motion about a second axis which is oblique relative to both longitudinal directions of the secondary arm and the second connecting arm.

8. The operator of claim 6, further comprising a sash stop fixed relative to said opposite window side and engageable with said connecting arms to ensure that said connecting arms are not disposed at less than a minimum selected angle relative to said sash opposite side to prevent lateral shifting and lock up of the window when said window is initially opened from a position closed against said frame.

9. The operator of claim 8, wherein said sash stop is integral with said bracket.

10. The operator of claim 1 wherein:

said planetary gear pivots about a first axis fixed on said primary arm;

said drive linkage includes two drive links pivotally connected together about a second axis, one of said drive links being fixed to said planetary gear and the other of said drive links being pivotally connected to the secondary arm about a third axis, said axes being substantially parallel; and said second axis substantially approaches a toggle position between the first and third axes when the window approaches a closed position relative to the frame.

11. An operator for an awning type window for controlling movement of a window sash for opening and closing relative to a window frame, said sash being pivotable about its top side relative to the window frame, comprising:

a drive gear pivotally mounted to a base on the frame;

a sun gear pivotable about an axis on said base and drivably engaging said drive gear;

a primary arm pivotable about the sun gear axis and including a planetary gear rotationally attached thereto and drivably engaging said sun gear;

a secondary arm pivotable about a second axis on said base;

a drive linkage fixed at one end to the planetary gear and pivotally connected at the other end to the secondary arm;

a bracket fixed to the sash side opposite the one sash side;

a first connecting arm pivotally connected at one end to the primary arm and at the other end to the bracket;

a second connecting arm pivotally connected at one end to the secondary arm and at the other end to the bracket, said primary, secondary, and connecting arms cooperating to move said opposite sash side toward and away from said frame in response to rotation of said drive gear; and a primary arm stop fixed relative to the base and engaging said primary arm to prevent lateral shifting of the window when said sash is closed against said frame.

12. The operator of claim 11, wherein:

said arms each have a longitudinal direction;

the first connecting arm is connected to the primary arm for pivotal motion about a first axis which is oblique relative to both longitudinal directions of the primary arm and the first connecting arm; and the second connecting arm is connected to the secondary arm for pivotal motion about a second axis which is oblique relative to both longitudinal directions of the secondary arm and the second connecting arm.

13. The operator of claim 11, further comprising means for preventing lateral shifting of the window when said window is initially opened from a position closed against said frame.

14. The operator of claim 13, wherein said means comprises a secondary arm stop fixed relative to the base and adapted to engage said secondary arm during initial opening of said window.

15. The operator of claim 11, further comprising a sash stop fixed relative to said opposite window side and engageable with said connecting arms to ensure that said connecting arms are not disposed at less than a minimum selected angle relative to said sash opposite side to prevent lateral shifting and lock up of the window when said window is initially opened from a position closed against said frame.

16. The operator of claim 11 wherein:

said planetary gear pivots about a first axis fixed on said primary arm;

said drive linkage includes two drive links pivotally connected together about a second axis, one of said drive links being fixed to said planetary gear and the other of said drive links being pivotally connected to the secondary arm about a third axis, said axes being substantially parallel; and said second axis substantially approaches a toggle position between the first and third axes when the window approaches a closed position relative to the frame.

17. An operator for an awning type window for controlling movement of a window sash for opening and closing relative to a window frame, said sash being pivotable about its top side relative to the window frame, comprising:

a drive gear pivotally mounted to a base on the frame;

a sun gear pivotable about an axis on said base and drivably engaging said drive gear;

a primary arm pivotable about the sun gear axis and including a planetary gear attached thereto for rotation about a first axis and drivably engaging said sun gear;

a secondary arm pivotable about a second axis on said base;

a pair of drive links pivotally interconnected about a second axis, one of said drive links being fixed to said planetary gear and the other of said drive links being pivotally connected about a third axis to the secondary arm;

a bracket fixed to the sash side opposite the one sash side;

a first connecting arm pivotally connected at one end to the primary arm and at the other end to the bracket;

a second connecting arm pivotally connected at one end to the secondary arm and at the other end to the bracket, said primary, secondary, and connecting arms cooperating to move said opposite sash side toward and away from said frame in response to rotation of said drive gear;

a primary arm stop fixed relative to the base and engaging said primary arm to prevent lateral shifting of the window when said sash is closed against said frame; and a secondary arm stop fixed relative to the base and adapted to engage said secondary arm to prevent lateral shifting of the window when said window is initially opened from a position closed against said frame;

wherein said second axis substantially approaches a toggle position between the first and third axes when the window approaches a closed position relative to the frame.

* * * * *